US008561706B2

(12) United States Patent
Averbuch et al.

(10) Patent No.: US 8,561,706 B2
(45) Date of Patent: Oct. 22, 2013

(54) RISER PIPE WITH RIGID AUXILIARY LINES AND OFFSET CONNECTORS

(75) Inventors: Daniel Averbuch, Vernaison (FR); Gérard Papon, Les Essarts le Roi (FR); Emmanuel Persent, Croissy sur Seine (FR)

(73) Assignee: IFP Energies Nouvelles, Rueil Malmaison (FR)

( * ) Notice: Subject to any disclaimer, the term of this patent is extended or adjusted under 35 U.S.C. 154(b) by 0 days.

(21) Appl. No.: 12/897,205

(22) Filed: Oct. 4, 2010

(65) Prior Publication Data

US 2011/0017466 A1 Jan. 27, 2011

(30) Foreign Application Priority Data

Oct. 7, 2009 (FR) ..... 09 04822

(51) Int. Cl.
*E21B 7/12* (2006.01)

(52) U.S. Cl.
USPC ..... 166/338; 166/339; 166/340; 166/341; 166/344

(58) Field of Classification Search
USPC ..... 166/338, 339, 340, 341, 344, 345, 367, 166/351, 360
See application file for complete search history.

(56) References Cited

U.S. PATENT DOCUMENTS

| | | | | |
|---|---|---|---|---|
| 4,514,254 | A | 4/1985 | Klepner | |
| 6,401,825 | B1 * | 6/2002 | Woodrow | 166/350 |
| 6,419,277 | B1 * | 7/2002 | Reynolds | 285/123.1 |
| 7,686,342 | B2 * | 3/2010 | Jennings et al. | 285/39 |
| 2002/0134553 | A1 * | 9/2002 | Woodrow | 166/367 |
| 2004/0074647 | A1 * | 4/2004 | Adams et al. | 166/338 |
| 2007/0044975 | A1 * | 3/2007 | Fraser et al. | 166/367 |
| 2009/0050330 | A1 * | 2/2009 | Papon et al. | 166/367 |
| 2009/0272537 | A1 * | 11/2009 | Alikin et al. | 166/367 |
| 2010/0300699 | A1 * | 12/2010 | Papon et al. | 166/367 |
| 2011/0073315 | A1 * | 3/2011 | Guesnon et al. | 166/367 |
| 2011/0192611 | A1 * | 8/2011 | Fraser et al. | 166/345 |

FOREIGN PATENT DOCUMENTS

| | | |
|---|---|---|
| FR | 2 432 672 | 2/1980 |
| FR | 2 464 426 | 3/1981 |
| FR | 2 526 517 | 11/1983 |
| FR | 2 557 194 A1 | 6/1985 |
| FR | 2 828 121 A1 | 2/2003 |
| FR | 2 828 262 A1 | 2/2003 |
| FR | 2 891 578 A1 | 4/2007 |
| FR | 2 891 579 A1 | 4/2007 |

* cited by examiner

*Primary Examiner* — Matthew Buck
*Assistant Examiner* — Aaron Lembo
(74) *Attorney, Agent, or Firm* — Antonelli, Terry, Stout & Kraus, LLP.

(57) ABSTRACT

The connection system allows to assemble two sections of a riser pipe used for offshore drilling, the riser pipe comprising a main tube and at least one auxiliary line arranged parallel to said tube. The connection system comprises a connector A for assembling two main tube sections and connecting means B1 for assembling two auxiliary line sections.

Connecting means B1 are arranged, with respect to connector A, in such a way that the overall dimensions E of the connection system are smaller than the sum of the overall dimensions EA of the connector and of the overall dimensions EB1 of the connecting means.

10 Claims, 7 Drawing Sheets

RISER PIPE WITH RIGID AUXILIARY LINES AND OFFSET CONNECTORS

FIELD OF THE INVENTION

The present invention relates to the field of very deep sea drilling and oil reservoir development. It concerns a riser pipe element comprising at least one line, or rigid auxiliary line, i.e. which can transmit tensional stresses between the top and the bottom of the riser.

BACKGROUND OF THE INVENTION

A drilling riser is made up of an assembly of tubular elements whose length generally ranges between 15 and 25 m, assembled by connectors. The weight of the riser borne by an offshore platform can be very great, which requires suspension means of very high capacity at the surface and suitable dimensions for the main tube and the connection fittings.

So far, the auxiliary lines: kill lines, choke lines, booster lines and hydraulic lines are arranged around the main tube and they comprise insertable fittings fastened to the riser element connectors in such a way that these high-pressure lines can allow a longitudinal relative displacement between two successive line elements, without any disconnection possibility however. Owing to these elements mounted sliding into one another, the lines intended to allow high-pressure circulation of an effluent coming from the well or from the surface cannot take part in the longitudinal mechanical strength of the structure consisting of the entire riser.

Now, in the perspective of drilling at water depths that can reach 3500 m or more, the dead weight of the auxiliary lines becomes very penalizing. This phenomenon is increased by the fact that, for the same maximum working pressure, the length of these lines requires a larger inside diameter considering the necessity to limit pressure drops.

Document FR-2,891,579 aims to involve the auxiliary lines, kill lines, choke lines, booster lines or hydraulic lines, in the longitudinal mechanical strength of the riser. According to this document, the tubes that make up an auxiliary line are assembled end to end by rigid connections allowing longitudinal stresses to be transmitted between two tubes. Thus, the auxiliary line makes up a rigid assembly that affords the advantage of transmitting stresses between the top and the bottom of the riser.

One drawback of the riser according to document FR-2,891,579 lies in the overall dimensions of the connectors. FIG. 1 describes an assembly of riser sections as described by document FR-2,891,579. The connection system for assembling two riser sections consists of a connector A intended to assemble two tubes of the main line, and connecting means B1 and B2 for assembling auxiliary line elements. When connector A and connecting means B1 and B2 are arranged in the same plane, the radial dimensions E of the connection system are substantially equal to the sum of the radial dimensions EA of connector 1 and of the radial dimensions EB1 and EB2 of connecting means B1 and B2. This layout can lead to obtain large overall dimensions E that can be greater than the maximum opening diameter of the rotary table used upon assembly and when lowering or raising a riser at sea.

The present invention provides axial and radial offset of the auxiliary line connectors with respect to the main tube connector in order to reduce the overall dimensions of the riser.

SUMMARY OF THE INVENTION

In general terms, the invention relates to a connection system for assembling two sections of a riser pipe used for offshore drilling. The riser comprises a main tube and at least one auxiliary line arranged parallel to said tube. The connection system comprises a connector including a first locking ring whose rotation forms a first axial stop for assembling two main tube sections, and connecting means comprising a second locking ring whose rotation forms a second axial stop for assembling two auxiliary sections. According to the invention, the connecting means are offset in the direction of the axis of the riser with respect to the connector so that the cylinder wherein the connecting means are inscribed overlaps the cylinder wherein the connector is inscribed, said cylinders being parallel to the axis of the riser.

According to the invention, the cylinder wherein the connecting means are inscribed can cover at least 5% of a diameter of the cylinder wherein the connector is inscribed.

The connector can consist of a bayonet locking system and the connecting means can consist of a bayonet locking system, each bayonet locking system being made up of a male tubular element and of a female tubular element that fit into one another and having an axial shoulder for longitudinal positioning of the male tubular element with respect to the female tubular element, a locking ring mounted mobile in rotation on one of the tubular elements, the ring comprising studs that cooperate with the studs of the other tubular element so as to form a bayonet assembly.

The female tubular element can comprise a shoulder serving as a supporting surface for a rotary table and, in this case, the first stop can be offset with respect to the second axial stop by a distance that is at least greater than the distance between said shoulder and the end of the female tubular element.

The ring of the connector can cooperate with the ring of the locking means so that the rotation of the connector ring causes rotation of the locking ring of the connecting means.

An auxiliary line section can be secured to a main tube section,

At least one of the elements selected from the group consisting of a main tube section and of an auxiliary line section can comprise a steel tube hooped by composite strips. Said composite strips can comprise glass, carbon or aramid fibers, coated with a polymer matrix.

At least one of the elements selected from the group consisting of a main tube section and of an auxiliary line section can be made of a material selected from the list consisting of a composite material comprising reinforcing fibers coated with a polymer matrix, an aluminium alloy, a titanium alloy.

The present invention also describes a riser comprising at least two riser sections assembled end to end by a system according to the invention, wherein an auxiliary line section transmits longitudinal stresses to the auxiliary line section to which it is assembled.

BRIEF DESCRIPTION OF THE FIGURES

Other features and advantages of the invention will be clear from reading the description hereafter, with reference to the accompanying figures wherein.

DETAILED DESCRIPTION

Figure 1:
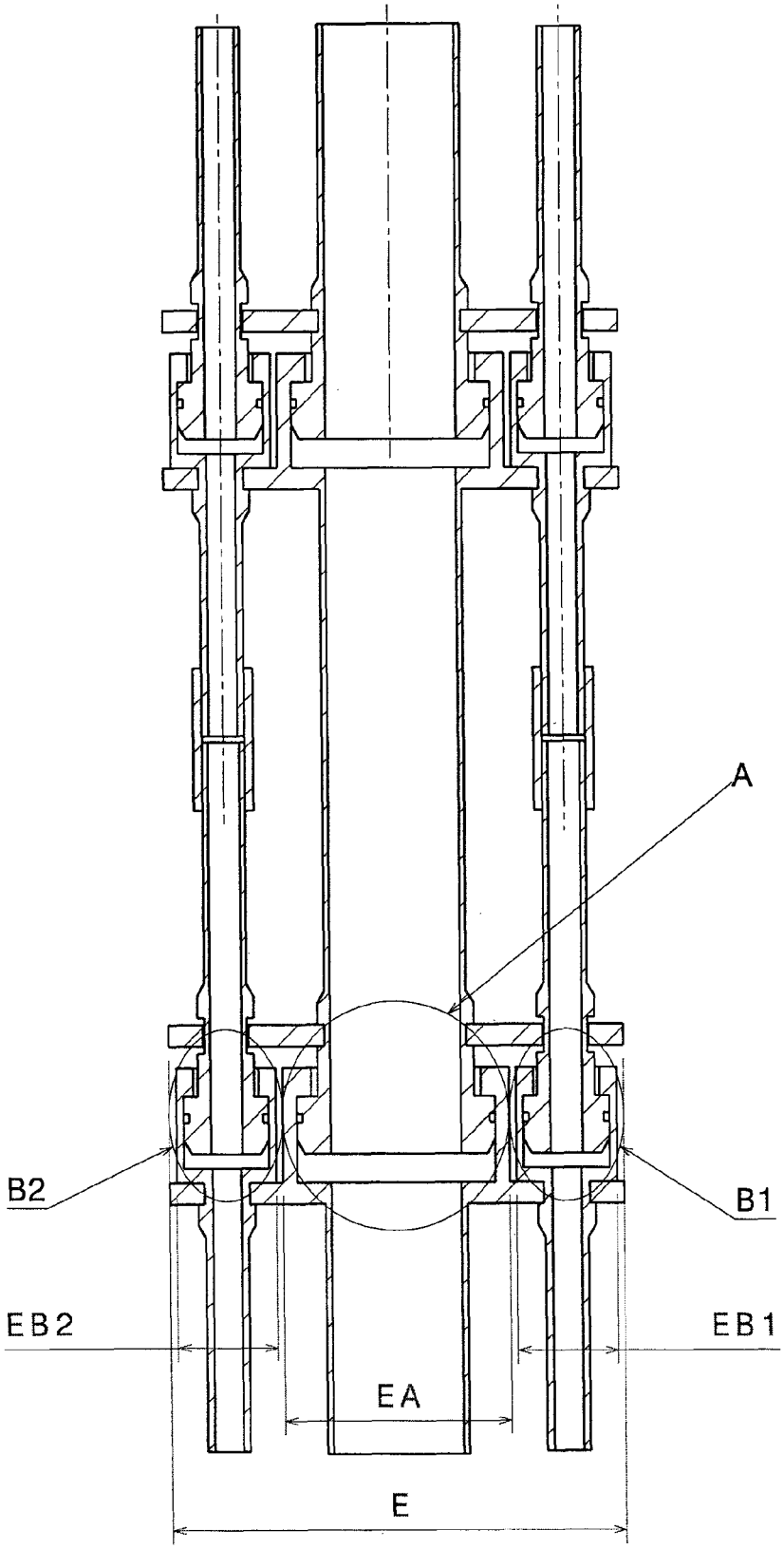
FIG. 1 diagrammatically shows a riser section assembly with a connection system according to the prior art, FIG. 2 diagrammatically shows a riser.
Figure 2:
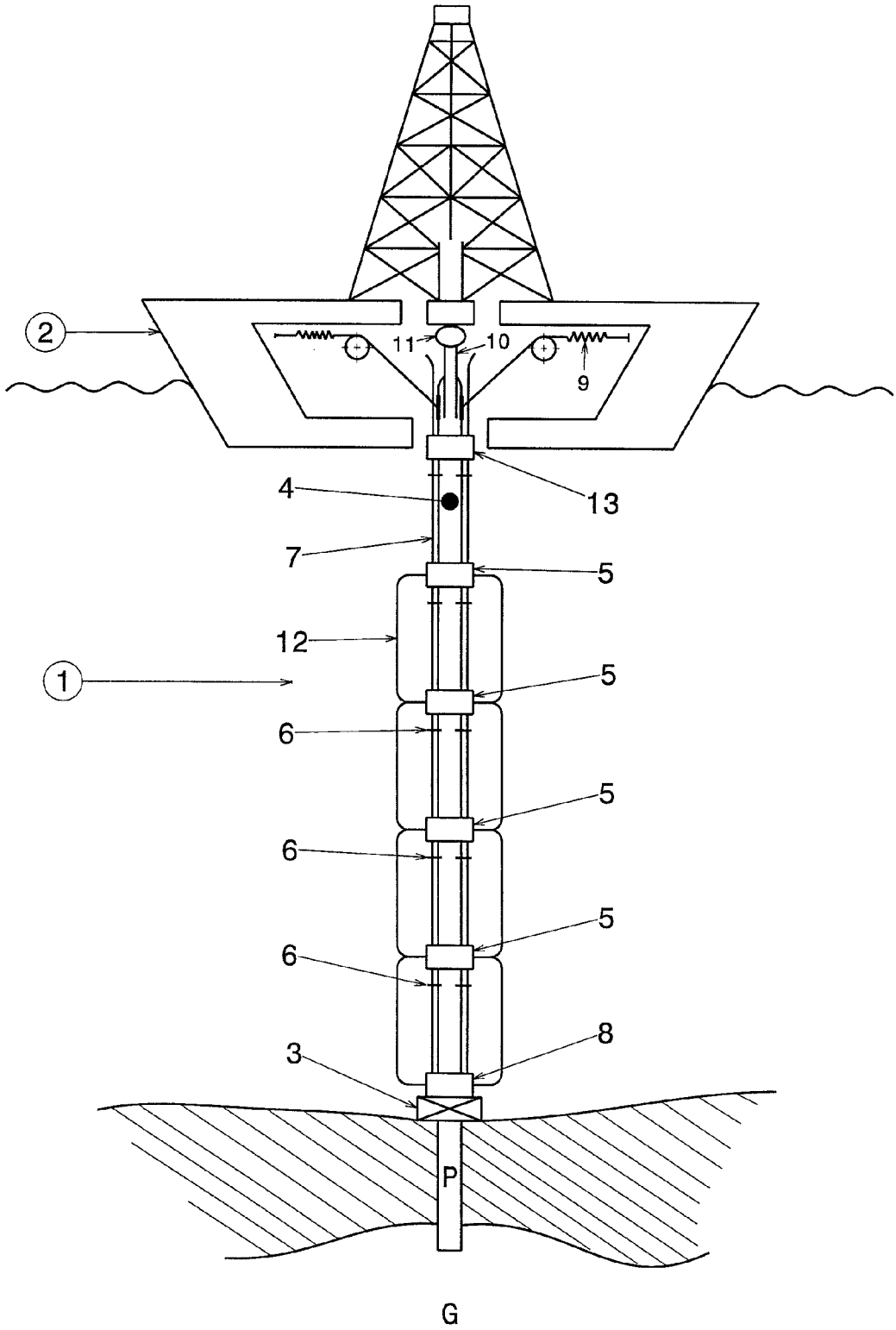

FIG. 2 diagrammatically shows a riser 1 installed at sea, intended for drilling a well P for development of reservoir G. Riser 1 forms an extension of well P and it extends from wellhead 3 to floater 2, a floating platform, a barge or a vessel for example. Wellhead 3 is provided with preventers commonly referred to as "BOPs" or "Blow-Out Preventers".

The riser diagrammatically shown in FIG. 2 comprises a main tube 4 and auxiliary lines 7.

With reference to FIG. 2, auxiliary lines 7 are arranged parallel to and on the periphery of main tube 4. The auxiliary lines referred to as kill line and choke line are used for circulating fluids between the well and the surface, or vice versa, when the BOPs are closed notably in order to allow control procedures relative to the inflow of fluids under pressure in the well. The auxiliary line referred to as booster line allows mud to be injected at the bottom of the riser. The auxiliary line(s) referred to as hydraulic line(s) allow to transfer a fluid under pressure for controlling the BOPs of the wellhead.

Main tube 4 and auxiliary lines 7 are made up of several tube sections assembled end to end by connection systems 5.

In the lower part, riser 1 is connected to wellhead 3 by means of LMRP (or Lower Marine Riser Package) 8. The link between connecting means 8 and the riser can comprise a joint, commonly referred to as ball joint or flex joint, which allows an angular travel of several degrees.

In the upper part, riser 1 is fastened to floater 2 by a system of tensioners 9 consisting, for example, of an assembly of hydraulic jacks, oleopneumatic accumulators, transfer cables and idler sheaves.

The hydraulic continuity of riser 1 up to the rig floor is provided by a system of sliding tubes 10, commonly referred to as slip joint, and by a joint 11 allowing an angular travel of several degrees.

Floats 12 in form of syntactic foam modules or made of other materials of lower density than sea water are fastened to main tube 4. Floats 12 allow to lighten riser 1 when it is immersed and to reduce the tension required at the top of the riser by means of the tensioners.

The main tube and each auxiliary line 7 are connected to wellhead 3 by connectors 8 and to sliding tube system 10 by connectors 13, connectors 13 and 8 transmitting the longitudinal stresses from the tensioners secured to the floater to the wellhead via the riser. Connecting means 5 allow to achieve rigid links between the riser elements. Connection systems 5 allow to achieve a rigid link between two main tube elements. Thus, main tube 4 forms a mechanically rigid assembly that takes up the longitudinal stresses between wellhead 3 and floater 2. Furthermore, connection systems 5 allow to achieve a rigid link between two elements of an auxiliary line. In this case, each auxiliary line 7 separately forms an assembly of mechanically rigid elements that also takes up the longitudinal stresses between wellhead 3 and floater 2. Consequently, the longitudinal stresses applied to the riser are distributed among main tube 4 and the various auxiliary lines 7.

Furthermore, each element of an auxiliary line 7 is secured to main tube 4 by fastening means 6 generally arranged close to connectors 5. These fastening means allow the auxiliary tubes to be positioned with respect to the main tube so as to fix the axial and radial position of the connectors. Furthermore, means 6 can be suited to distribute or to balance the stresses among the various auxiliary lines and the main tube, notably if the deformations between the auxiliary lines and the main tube are not equal, for example in case of a pressure and temperature variation between the various lines.

Figure 3:
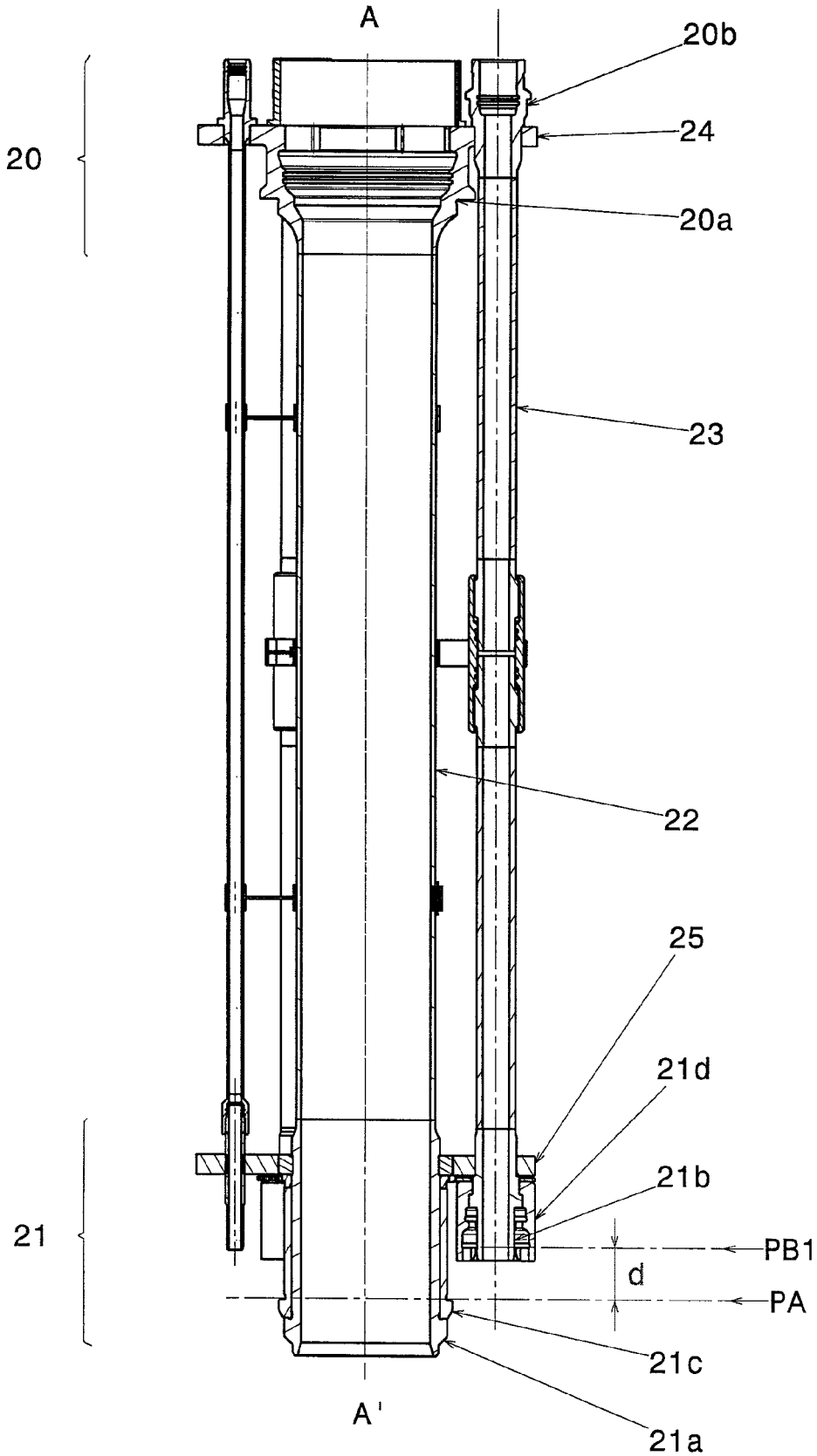
FIG. 3 shows in detail a riser section with a connection system according to the invention, FIG. 4 diagrammatically shows a connection system according to the invention in connected position.

FIG. 3 shows a riser section assembled with connection systems according to the invention. The section is provided, at one end thereof, with a connection system 20 and, at the other end, with a connection system 21. In order to make up a riser, several sections are assembled end to end, connecting means 20 of a section cooperating with the connecting means of another section.

The riser section comprises a main tube element 22 whose axis AA' is the axis of the riser. The auxiliary lines are arranged parallel to axis AA' of the riser so as to be integrated in the main tube. Reference number 23 designates the unit elements of the auxiliary lines. There is at least one element 23 arranged on the periphery of main tube 22. If there are several elements 23, they are preferably arranged around tube 22 so as to balance the load transfer of the riser.

Connecting means 20 and 21 consist of several connectors: main tube element 22 and each auxiliary line element 23 are each provided with a mechanical connector. These mechanical connectors allow to transmit longitudinal stresses from one element to the next. For example, the connectors can be of the type described in documents FR-2,432,672, FR-2,464,426, FR-2,526,517 and FR-2,557,194. These connectors allow two tube sections to be assembled together. With reference to FIG. 3, a main tube connector, respectively an auxiliary line connector, comprises a male tubular element 21*a*, respectively 21*b*, and a female tubular element 20*a*, respectively 20*b*, that fit into one another and have an axial shoulder for longitudinal positioning of the male tubular element with respect to the female tubular element. Each connector also comprises a locking ring mounted mobile in rotation on one of the tubular elements. The ring comprises studs that cooperate with the studs of the other tubular element so as to form a bayonet assembly. Ring 21*c* of the main tube connector is mounted to rotate on male tubular element 21*a* and it cooperates with the studs of female tubular element 20*a* of another riser section. Ring 21*d* is mounted to rotate on male tubular element 21*b* and it cooperates with the studs of female tubular element 20*b* of another riser section.

According to the invention, auxiliary line connectors consisting of elements 20*b*, 21*b* and 21*d* are judiciously positioned with respect to the main tube connector consisting of elements 20*a*, 21*a* and 21*c* so as to reduce the overall dimensions of all of the connectors. In order to reduce the diameter measured in a plane perpendicular to axis AA' of the riser, the auxiliary line connectors are offset along axis AA' with respect to the main tube connector and the distance between the axes of the auxiliary line connectors and axis AA' is reduced.

Figure 7:
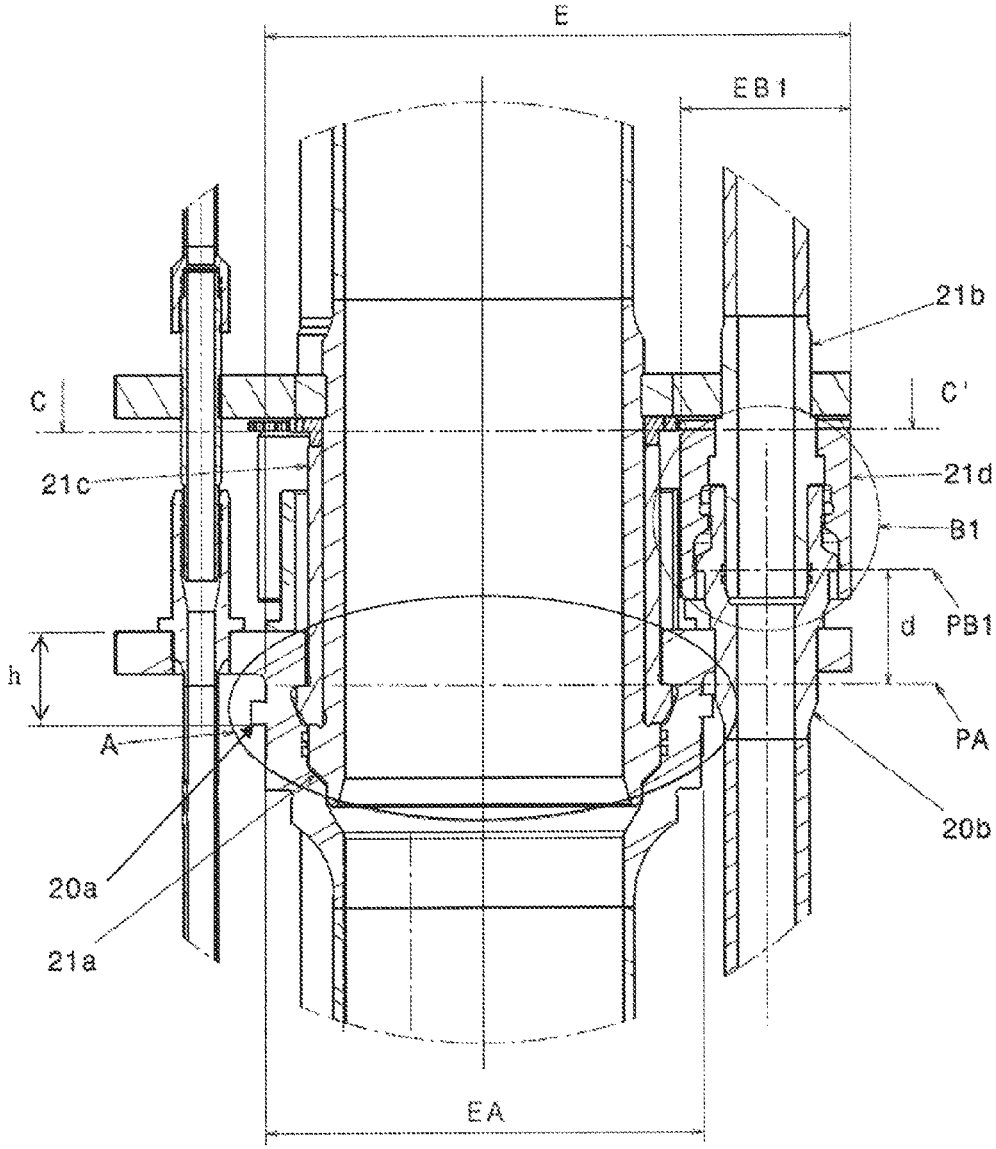
FIG. 7 shows in detail a riser section with a connection system according to the invention in which the distance d is greater than the value h measured on the female part of connector A.

According to the invention, the main tube connector and the auxiliary line connector each comprise studs that allow stresses to be transferred. In general, the studs of the main connector are arranged in a plane PA perpendicular to axis AA'. Generally, the studs of the auxiliary line connector are arranged in a plane PB1 perpendicular to axis AA'. In general, the parts of the connector that carry these studs are massive and bulky, they therefore have large overall dimensions because they have to transmit stresses between the connected pieces. According to the invention, the connectors are axially offset so that these massive parts are offset. Plane PA is offset by a distance d with respect to plane PB1, distance d being measured along axis AA', i.e. parallel to axis AA'. For example, as shown in FIG. 7, distance d can be greater than the value h measured on the female part of connector A.

Value h corresponds to the distance between the shoulder that comes into contact on the rotary table upon assembly of the riser and the end of the female part of connector A.

By axially offsetting the auxiliary line connectors with respect to the position of the main tube connector, the auxiliary line connectors can be moved closer to axis AA' without any element of an auxiliary line connector interfering with an element of the main tube connector.

Figure 4:
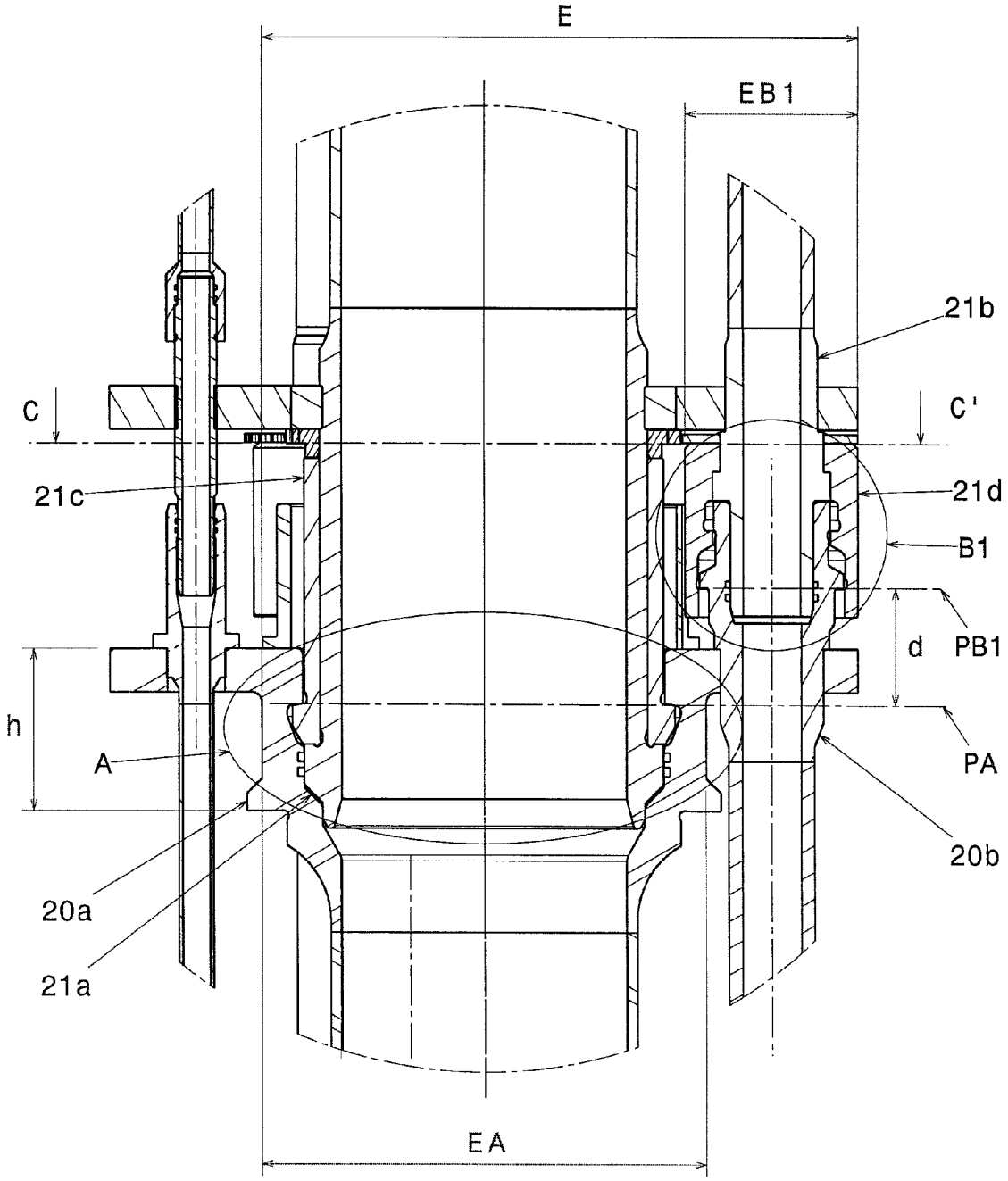

FIG. 4 diagrammatically shows an assembly of two riser sections by means of a connection system according to the invention. At the level of connector B1 of the auxiliary line, element 21*b* is fed into element 20*b*, ring 21*d* being in locked position. Plane PB1 indicates the surface of contact between the studs of female element 20*b* and the studs of ring 21*d*. At the level of main tube connector A, element 21*a* is fed into element 20*a*, ring 21*c* being in locked position. Plane PA indicates the surface of contact between the studs of female element 20*a* and the studs of ring 21*c*.

Connector B1 is axially offset with respect to connector A. Radial dimensions E of the system consisting of connector A and connector B1 are smaller than the sum of the radial dimensions EA of connector A and of the radial dimensions EB1 of connector B1. In other words, the cylinder of diameter EA wherein connector A is inscribed at the level of plane PA overlaps the cylinder of diameter EB1 wherein connector B1 is inscribed. The cylinder of diameter EA whose axis merges with axis AA' corresponds to the cylinder of smaller diameter that contains the part of connector A in plane PA. The cylinder of diameter EB1 whose axis merges with the axis of the auxiliary line corresponds to the cylinder of smaller diameter that contains the part of connector B1 in plane PB1.

Figure 6:
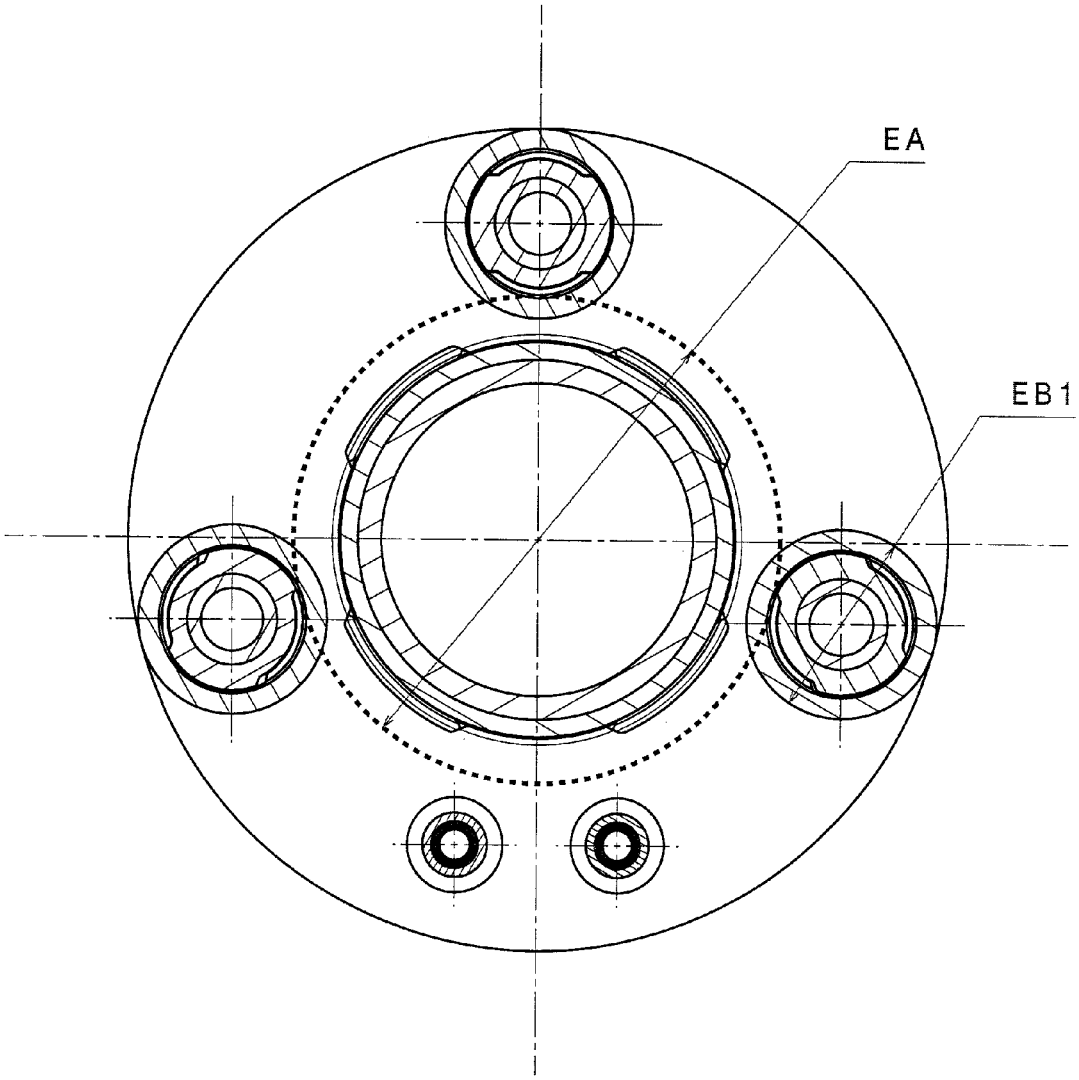

FIG. 6 shows the connector of FIG. 4 according to radial section CC'. FIG. 6 clearly shows the overlap, i.e. the intersection, of the cylinder of diameter EA on the cylinder of diameter EB1. According to the invention, the cylinder of diameter EA can cover at least 5%, preferably at least 10%, or even at least 15%, of diameter EA. However, considering the offset d between planes PA and PB1 shown in FIG. 4, the parts of connector A do not collide with the parts of connector B1. Thus, the position of connector A with respect to connector B according to the invention allows to reduce the overall dimensions of the connection system.

Figure 5:
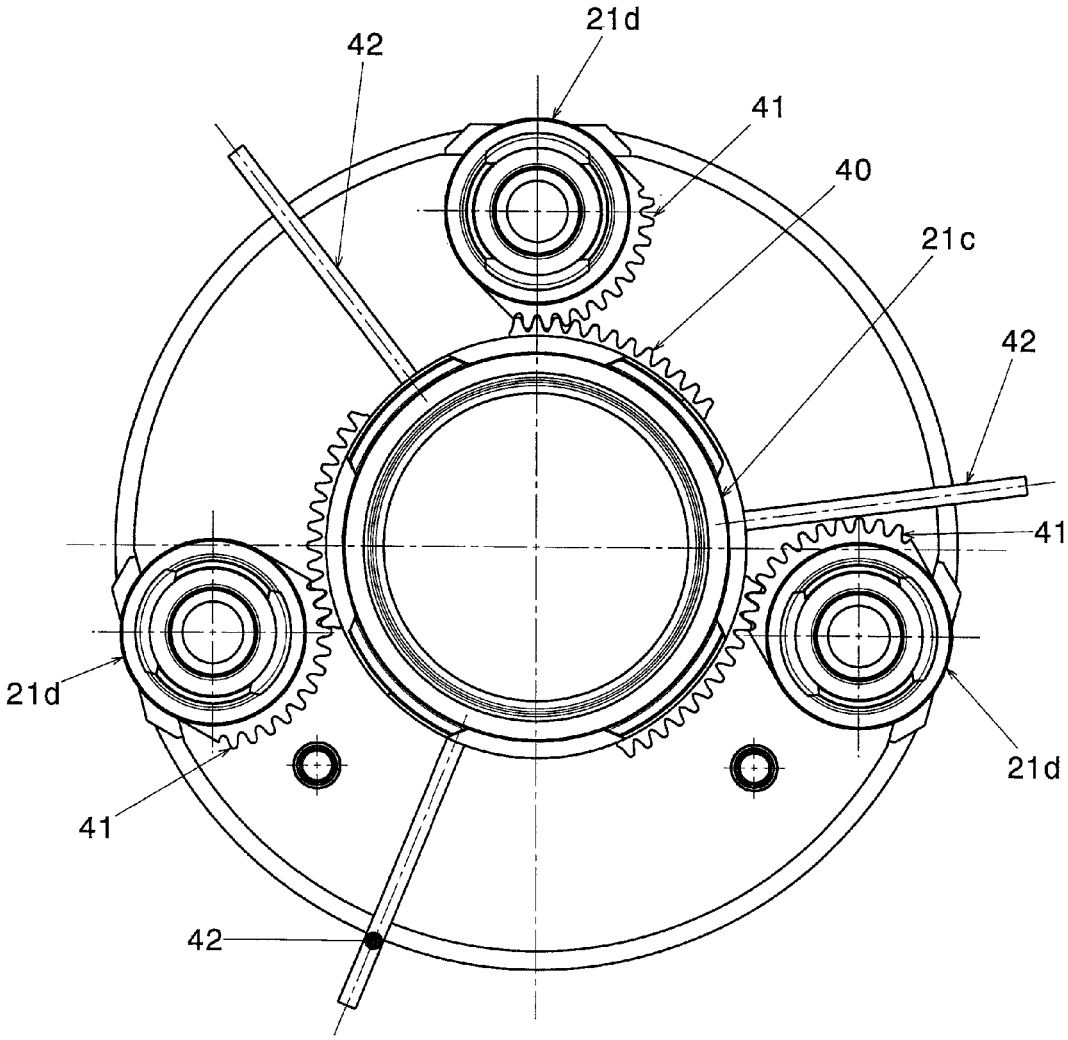
FIG. 5 shows in detail a synchronized locking system of a connection system according to the invention, FIG. 6 diagrammatically shows a sectional view of the connection system according to the invention.

In order to simplify assembly of the riser sections, connecting means 20 and 21 are provided with a locking system that allows the various connectors to be locked by actuating a single part. With reference to FIG. 5, on the one hand, the periphery of locking ring 21*c* of the connector of main tube 22 is fitted with a toothed crown 40. On the other hand, locking rings 21*d* of each connector of auxiliary line elements 23 are fitted with toothed sectors 41 that cooperate with toothed crown 40 of the connector of main tube 22. Thus, when rotating ring 21*c* of the main tube connector around axis AA', toothed crown 40 gears each one of toothed sectors 41 and thus causes rotation of each ring 21*d* of the connectors of auxiliary line elements 23. Toothed crown 40 can be operated by means of grab bars 42 that may be retractable. This system allowing simultaneous locking of the connector of tube 22 with the connectors of elements 23 can be applied to any type of connector using a rotating locking system.

Furthermore, auxiliary line element 23 can be secured to main tube 22. In other words, the riser section comprises fastening means 6 shown in FIG. 2 that allow auxiliary line element 23 to be mechanically fastened to main tube 22. Fastening means 6 position and secure element 23 onto tube 22. For example, with reference to FIG. 3, fastening means 6 comprise plates 24 and 25. Plates 24 and 25 are secured to each end of main tube 22 at the level of connector elements 20*a* and 21*a*. The ends of the auxiliary lines comprise grooves at the level of connector elements 20*b* and 21*b* that fit into hollows provided on the periphery of plates 24 and 25.

Furthermore, in order to produce risers that can operate at depths reaching 3500 m and more, the main tube and the auxiliary lines can be made with metallic tube elements whose resistance is optimized by composite hoops made of fibers coated with a polymer matrix.

A tube hooping technique can be the technique consisting in winding under tension composite strips around a metallic tubular body, as described in documents FR-2,828,121, FR-2, 828,262 and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very low stress in the metallic tube. Then a predetermined pressure is applied to the inside of the metallic body so that the metallic body deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensional stresses.

According to another embodiment, tubes 22 and tubes 23 that make up the auxiliary lines can be made of an aluminium alloy. For example, aluminium alloys with ASTM (American Standard for Testing and Material) references 1050, 1100, 2014, 2024, 3003, 5052, 6063, 6082, 5083, 5086, 6061, 6013, 7050, 7075, 7055 or aluminium alloys marketed under reference numbers C405, CU31, C555, CU92, C805, C855, C70H by the ALCOA Company can be used.

Alternatively, tubes 22 and tubes 23 that make up the auxiliary lines can be made of a composite material consisting of fibers coated with a polymer matrix. The fibers can be carbon, glass or aramid fibers. The polymer matrix can be a thermoplastic material such as polyethylene, polyamide (notably PA11, PA6, PA6-6 or PA12), polyetheretherketone (PEEK) or polyvinylidene fluoride (PVDF). The polymer matrix can also be made of a thermosetting material such as epoxys.

Alternatively, tubes 22 and tubes 23 that make up the auxiliary lines can be made of a titanium alloy. For example, a Ti-6-4 titanium alloy (alloy comprising, in wt.%, at least 85% titanium, about 6% aluminium and 4% vanadium) or the Ti-6-6-2 alloy comprising, in wt.%, about 6% aluminium, 6% vanadium, 2% tin and at least 80% titanium, can be used.

The invention claimed is:

1. A connection system for assembling two sections of a riser pipe used for offshore drilling, each of the two sections of the riser comprising a main tube section and at least one auxiliary line section arranged parallel to said main tube section, the connection system comprising a main tube connector including a first locking ring—whose rotation forms a first axial stop for assembling the main tube section of each of the two sections of the riser, and at least—one auxiliary line connector comprising a second locking ring—whose rotation forms a second axial stop for assembling the at least one auxiliary section of each of the two sections of the riser, wherein the at least one auxiliary line connector is offset in the direction of the axis of the riser with respect to the main tube connector including when the two sections of the riser are assembled by the connection system so that the cylinder wherein the at least one auxiliary line connector is inscribed overlaps the cylinder wherein the main tube connector—is inscribed, said cylinders being parallel to the axis of the riser.

2. A connection system as claimed in claim 1, wherein the cylinder wherein the at least one auxiliary line connector is inscribed covers at least 5% of a diameter of the cylinder wherein the main tube connector is inscribed.

3. A connection system as claimed in claim 1, wherein the main tube connector comprises a bayonet locking system and wherein the at least one auxiliary line connector comprises a bayonet locking system, each bayonet locking system being made up of a male tubular element—and of a female tubular element—that fit into one another and having an axial shoulder for longitudinal positioning of the male tubular element with respect to the female tubular element, a locking ring—mounted mobile in rotation on one of the tubular elements, the locking ring comprising studs that cooperate with studs of the other tubular element so as to form a bayonet assembly.

4. A connection system as claimed in claim 3, wherein the female tubular element comprises an outer shoulder serving as a supporting surface and wherein the first stop is offset with respect to the second axial stop by a distance (d) that is at least greater than distance (h) between said outer shoulder of the female tubular element and the end of the female tubular element.

5. A connection system as claimed in claim 3, wherein the locking ring of the main tube connector cooperates with the locking ring of the at least one auxiliary line connector so that the rotation of the locking ring of the main tube connector causes rotation of the locking ring of the at least one auxiliary line connector.

6. A connection system as claimed in claim 1, wherein the at least one auxiliary line section is secured to the main tube section.

7. A connection system as claimed in claim 1, wherein at least one of the elements selected from the group consisting of a main tube section and of an auxiliary line section comprises a steel tube hooped by composite strips.

8. A connection system as claimed in claim 7, wherein said composite strips comprise glass, carbon or aramid fibers, coated with a polymer matrix.

9. A connection system as claimed in any claim 1, wherein at least one of the elements selected from the group consisting of a main tube section and of an auxiliary line section is made of a material selected from the list consisting of a composite material comprising reinforcing fibers coated with a polymer matrix, an aluminium alloy, a titanium alloy.

10. A riser comprising at least two riser sections assembled end to end by a system as claimed in claim 1, wherein an auxiliary line section transmits longitudinal stresses to the auxiliary line section to which it is assembled.

* * * * *